United States Patent [19]

Milstein

[11] B 3,985,643

[45] Oct. 12, 1976

[54] DEMETALATION AND DESULFURIZATION OF OIL IN SEPARATE CATALYTIC ZONES

[75] Inventor: Donald Milstein, Cherry Hill, N.J.

[73] Assignee: Mobil Oil Corporation, New York, N.Y.

[22] Filed: Aug. 28, 1974

[21] Appl. No.: 501,317

[44] Published under the second Trial Voluntary Protest Program on January 13, 1976 as document No. B 501,317.

Related U.S. Application Data

[63] Continuation-in-part of Ser. No. 393,092, Aug. 30, 1973, abandoned.

[52] U.S. Cl. ..... 208/210; 208/251 H

[51] Int. Cl.[2] ..... C10G 23/00

[58] Field of Search ..... 208/209, 210, 211, 251 H

[56] References Cited

UNITED STATES PATENTS

| | | | |
|---|---|---|---|
| 2,174,510 | 10/1939 | Gwynn | 208/210 |
| 3,291,721 | 12/1966 | Schuman | 208/210 |
| 3,607,725 | 9/1971 | Irvine et al. | 208/251 H |
| 3,809,644 | 5/1974 | Johnson et al. | 208/210 |

*Primary Examiner*—Delbert E. Gantz
*Assistant Examiner*—G. J. Crasanakis
*Attorney, Agent, or Firm*—Charles A. Huggett; Vincent J. Frilette

[57] ABSTRACT

An improved process for desulfurization of metals and sulfur containing petroleum oils, preferably those containing residua hydrocarbon components, comprising passing the sulfur containing petroleum oils through a bed of substantially aged desulfurization catalyst at a temperature not less than 770°F preceeding conventional hydrodesulfurization treatment.

7 Claims, 1 Drawing Figure

EFFECT OF TEMPERATURE ON CATALYST METALS POISONING

KUWAIT ATM. RESID. 2000 PSIG, 0.75 LHSV, 5000 SCF $H_2$ / BBL

EFFECT OF TEMPERATURE ON CATALYST METALS POISONING

KUWAIT ATM. RESID. 2000 PSIG, 0.75 LHSV, 5000 SCF $H_2$ / BBL

DEMETALATION AND DESULFURIZATION OF OIL IN SEPARATE CATALYTIC ZONES

RELATED CASES

This case is a continuation in part of U.S. Patent Application Ser. No. 393,092 filed Aug. 30, 1973 and now abandoned.

BACKGROUND OF THE INVENTION

1. Field of the Invention

This invention relates to the hydrodesulfurization of petroleum oils, preferably those containing residua hydrocarbon components, and having a significant metals and sulfur content. More particularly the invention relates to an improved method for desulfurization which allows for significantly longer operating cycles and/or reduced operating severity; a reduced operating severity produces a correspondingly reduced investment and operating cost.

2. Description of the Prior Art

The benefits of purifying petroleum fractions through hydrogen processing are well known. Due primarily to a lack of inexpensive hydrogen and the relatively high pressures required, the process did not develop commercially to a substantial extent until the advent of catalytic reforming, which produced hydrogen rich off-gas as a byproduct. The functions of hydrogen treating are primarily removal of sulfur compounds, nitrogen compounds and other impurities; hydrogen saturation of olefins and/or aromatics; and mild hydrocracking. Certainly one of the most commercially important functions is that of sulfur removal.

It has been proposed to improve the salability of high sulfur content, residual-containing petroleum oils by a variety of hydrodesulfurization processes. However, difficulty has been experienced in achieving an economically feasible catalytic hydrodesulfurization process, because notwithstanding the fact that the desulfurized products may have a wider marketability, the manufacturer may be able to charge little or no additional premium for the low sulfur desulfurized products, and since hydrodesulfurization operating costs have tended to be relatively high in view of the previously experienced, relatively short life for catalysts used in hydrodesulfurization of residual-containing stocks. Short catalyst life is manifested by inability of a catalyst to maintain a relatively high capability for desulfurizing chargestock with increasing quantities of coke and/or metallic contaminants which act as catalyst poisons. Satisfactory catalyst life can be obtained relatively easily with distillate oils but is especially difficult to obtain in desulfurizing petroleum oils containing residual components, since the asphaltene or asphaltic components of an oil, which tend to form disproportionate amounts of coke, are concentrated in the residual fractions of a petroleum oil, and since a relatively high proportion of the metallic contaminants that normally tend to poison catalysts are commonly found in the asphaltene components of the oil.

The most common desulfurization catalyst is cobalt molybate on an alumina base, however any of the Group VIB and Group VIII metals may be employed as a hydrogenation component on a suitable refractory base material. Typical operating condition ranges for resid and/or crude desulfurization are a temperature of about 650° to 850°F., a space velocity of about 0.1 to 5.0 L.H.S.V., a pressure of about 500 to 3,000 p.s.i.g. and a hydrogen circulation of about 1,000 to 15,000 s.c.f./bbl of feed.

The removal of metals in hydrodesulfurization operations is generally undesirable since the typical desulfurization catalyst such as cobalt molybate on an alumina base is poisoned by metals deposition. In the past, this type of process has been operated in such a manner as to maintain a substantially constant conversion or severity, that is level of sulfur removal. In order to achieve this desired level of sulfur removal, the operating conditions were steadily increased in severity to compensate for the gradual catalyst deactivation primarily due to metals poisoning and coking.

Process severity may be described as being directly related to temperature and pressure, and inversely proportionated to the space velocity of the process. Thus in order to increase severity, one might increase pressure and/or temperature or decrease the space velocity. As most process units are sized based on throughput and pressure, neither the contact time nor the pressure can be significantly increased, therefore severity is typically increased through a temperature increase. Thus most residua desulfurization reactors are initially operated at a "start of run" temperature of about 650°F to 750°F. As the desulfurization catalyst activity decreases due e.g., to metals deposition and coke formation, the reaction severity is increased by increasing the temperature, so as to maintain a desired substantially constant sulfur removal level. "End of run temperature" is typically about 800°F and is reached when the catalyst activity has been significantly decreased, e.g., due to metals poisoning and coking. Were it not for such metals poisoning of the desulfurization catalyst, the operating cycles could be lengthened, or the severity could be reduced (lower temperatures and/or pressures and/or increased space velocities).

At the present time, and certainly for several years into the foreseeable future, low sulfur fuel oils are and will be in critical demand. At the same time that recent legislation has reduced the allowable sulfur levels in fuel oils, the overall demand for fuel oils has increased markedly. As a consequence, the need for desulfurized petroleum products such as fuel oils has been doubly increased.

An object of this invention is to provide a method of hydrodesulfurization of metals and sulfur containing petroleum oils, preferably those containing residua hydrocarbon fractions, whereby the operating cycle, that is, number of days on stream, for such a process may be significantly increased, without any significant decrease in sulfur removal. An additional object of this invention is to provide a method of hydrodesulfurization of petroleum oils, preferably those containing residua hydrocarbon fractions, whereby the severity of the operation and its attendant investment and operating cost are decreased. That is, pressure and/or temperature might be reduced and/or the space velocity increased, without any significant decrease in sulfur removal. Another object of this invention is to provide a method of hydrodesulfurization whereby the metals poisoning of the desulfurization catalyst is significantly reduced. Other and additional objectives of this invention will become obvious to those skilled in the art following a consideration of the entire specification including the drawing and claims.

SUMMARY OF THE INVENTION

Figure 1:
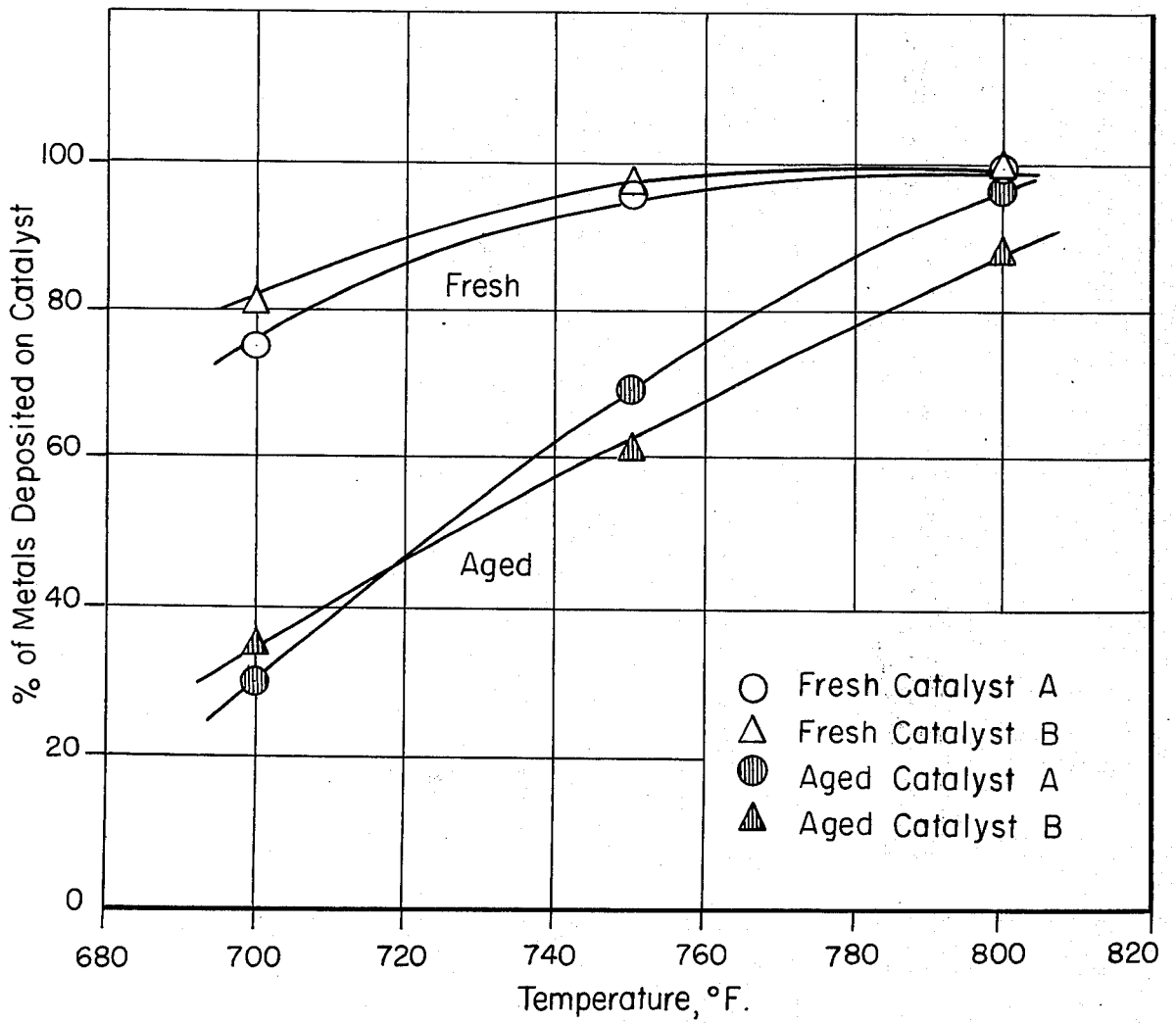
FIG. 1 is a curve illustrating the metals deposition as a function of temperature for two typical hydrodesulfurization catalysts.

While one might assume that the metals lay down rate is constant for a constant severity, it has been discovered that aged hydrodesulfurization catalysts are extremely temperature sensitive with regard to metals poisoning. This is to say, the metals deposition produced by a given temperature increase is greater for an aged catalyst than for a fresh catalyst. FIG. 1 is an illustration of this finding. FIG. 1 shows the effect of temperature on metal poisoning for two cobalt molybate on alumina hydrodesulfurization catalyst in both fresh condition (no metals poisoning) and aged condition (substantial metals and coke poisoning). The aged catalysts were utilized to desulfurize a Kuwait atmospheric resid for 75 days under the following conditions: 2,000 p.s.i.g., 0.75 L.H.S.V. 5,000 scf $H_2$/bbl. and 750° – 800°F. As illustrated by FIG. 1, the metals poisoning of the aged catalyst was relatively modest at low temperatures being substantially less than that of fresh catalyst; however, the poisoning increased to almost equal that of fresh catalyst at high temperatures. The information of FIG. 1 may be more fully described by referring to Table 2.

TABLE 2

LOSS IN CATALYST ACTIVITY ON AGING
Catalyst A, aged with Kuwait Atm. Resid, 2000 psig, 0.75 LHSV, 750 – 800°F for 75 days

| Temperature, °F: | 700 | | 800 | |
|---|---|---|---|---|
| | % Desulf. | % Demet. | % Desulf. | % Demet. |
| Fresh Catalyst: | 48 | 75 | 85 | 99 |
| Aged Catalyst: | 26 | 30 | 62 | 96 |
| Loss in Activity: | 22 | 45 | 23 | 3 |

Table 2 shows aged catalyst A has lost 45% demetalation activity at 700°F, but only 3% at 800°F. Also, loss in desulfurization activity does not show this surprising and unexpected temperature sensitivity.

In the hydrodesulfurization process for low sulfur fuel oils, minimum metals deposition is obviously desired since it is a major cause of catalyst deactivation. One approach to the problem that has been considered is use of a "cheap" demetalation catalyst ahead of the desulfurization operation. Unfortunately, most of the cheap demetalation catalysts that have been identified are non-extruded materials which are not suitable for use in a fixed-bed reactor for pressure drop reasons. Extruded demetalation catalysts are too expensive for the operation to be economical.

The unexpected finding of this invention, however, now provides a source of inexpensive, extruded demetalation catalysts for use in a fixed-bed operation. Spent desulfurization catalysts, which are not commercially further usable for desulfurization have a value of only several cents a pound, the value of metal recovered therefrom. As shown herein, if these spent catalysts are used at a high temperature, their demetalation activity is about that of fresh catalyst.

This invention relates to an improved process for desulfurization of metals and sulfur containing petroleum oils, preferably those containing residua hydrocarbon components, comprising passing said petroleum oils through a bed of said aged catalyst at a temperature of at least 770°F prior to conventional hydrodesulfurization thereby taking advantage of the aged catalyst's demetalation activity at high temperatures.

Principal crude oil metal contaminants are nickel and vanadium, with iron and small amounts of copper also sometimes present. Additionally, trace amounts of zinc and sodium are present on occasion. As the great majority of these metals when present in crude oil are associated with very large hydrocarbon molecules, the heavier fractions produced by crude distillation contain substantially all the metal present in the crude, such metals being particularly concentrated in the asphaltine residual fraction. The metal contaminants are typically large organometallic complexes such as metal prophyrins and asphaltines. A typical Kuwait atmospheric residua, generally considered of average metals content, has a metals content of about 50 to 60 ppm by weight.

The feedstock to be desulfurized can be any metal-contaminant containing petroleum stock preferably one containing residual fractions.

From what has been said, it will be clear that the feedstock can be a whole crude. However, since the high metal and sulfur components of a crude oil tend to be concentrated in the higher boiling fractions, the present process more commonly will be applied to a bottoms fraction of a petroleum oil, i.e., one which is obtained by atmospheric distillation of a crude petroleum oil to remove lower boiling materials such as naphtha and furnace oil, or by vacuum distillation of an atmospheric residue to remove gas oil. Typical residues to which the present invention is applicable will normally be substantially composed of residual hydrocarbons boiling above 650°F and containing a substantial quantity of asphaltic materials. Thus the chargestock can be one having an initial or 5 percent boiling point somewhat below 650°F, provided that a substantial proportion, for example, about 70 or 80 percent by volume, of its hydrocarbon components boil above 650°F. A hydrocarbon stock having a 50 percent boiling point of about 900°F and which contains asphaltic materials, 4% by weight sulfur and 50 p.p.m. nickel and vanadium is illustrative of such chargestock. Typical process conditions may be defined as contacting a metal and or sulfur contaminant containing a chargestock with a hydrodesulfurization catalyst under a hydrogen pressure of about 500 to 3,000 p.s.i.g., of 650° to 850°F. temperature, and 0.1 to 5 LHSV.

The hydrogen gas which is used during the hydrodesulfurization is circulated at a rate between about 1,000 and 15,000 s.c.f./bbl. of feed and preferably between about 3,000 and 8,000 s.c.f./bbl. The hydrogen purity may vary from about 60 to 100 percent. If the hydrogen is recycled, which is customary, it may be desirable to provide for bleeding off a portion of the recycled gas. Makeup hydrogen is added since hydrogen ($H_2$) is consumed during the process. The recycled gas can be washed with a chemical absorbent for hydrogen sulfide or otherwise treated in known manner to reduce the hydrogen sulfide content thereof prior to recycling.

When the use of a desulfurization catalyst in sulfided form is desired, the catalyst can be presulfided, after calcination, or calcination and reduction, prior to contact with the chargestock by contact with a sulfiding mixture of hydrogen and hydrogen sulfide.

Although presulfiding of the catalyst is preferred, it is emphasized that this is not essential as the catalyst will normally become sulfided in a very short time by contact, at the process conditions disclosed herein, with the high sulfur content feedstocks to be used.

What is claimed is:

1. In a process for hydrodesulfurizing a petroleum oil that contains residual hydrocarbon components including metals, wherein said oil and hydrogen are passed serially through two separate catalytic zones at a space velocity of about 0.1 to 5.0 L.H.S.V., a pressure of about 500 to 3,000 p.s.i.g., and with a hydrogen circulation rate of about 1,000 to 15,000 s.c.f./bbl., and at a temperature progressively increased in both catalytic zones from a start-of-run temperature of about 650°F to an end-of-run temperature of about 800°F at which temperature the active hydrodesulfurization catalyst in the second catalytic zone becomes spent, the improvement comprising taking advantage of said spent catalyst's demetalation activity by passing said oil that contains residual hydrocarbon components, and hydrogen, at a start-of-run temperature of at least about 770°F, through said first catalytic zone containing catalyst consisting essentially of said spent catalyst from said second reaction zone, thereby forming demetallized oil; and passing said demetallized oil and hydrogen, at a start-of-run temperature of about 650°F through said second reaction zone containing active hydrodesulfurization catalyst comprising a Group VIB and a Group VIII metal on alumina.

2. The process of claim 1 wherein said petroleum oil is a residual oil.

3. The process of claim 1 wherein said petroleum oil has a 50 percent boiling point of about 900°F.

4. The process of claim 1 wherein said petroleum oil that contains metals is a crude oil.

5. The process of claim 1 wherein said active hydrodesulfurization catalyst is cobalt molybdate on alumina.

6. The process of claim 1 wherein said catalyst in said first and second catalytic zones are fixed bed catalysts.

7. The process of claim 6 in which said start-of-run temperatures are progressively increased to end-of-run temperature, whereby maintaining constant severity.

* * * * *